United States Patent [19]

Haimerl

[11] 4,029,336

[45] June 14, 1977

[54] CONVERTIBLE SKI BINDING

[76] Inventor: Dennis J. Haimerl, Rte. 1, Box 148-A, Loma, Colo. 81524

[22] Filed: Oct. 20, 1975

[21] Appl. No.: 623,739

[52] U.S. Cl. ..... 280/614; 280/619; 280/626

[51] Int. Cl.[2] ..... A63C 9/00

[58] Field of Search ..... 280/614, 615, 623, 626, 280/631, 632, 630, 628, 619, 627

[56] References Cited

UNITED STATES PATENTS

| | | | |
|---|---|---|---|
| 1,964,103 | 6/1934 | Attenhofer | 280/614 |
| 2,172,669 | 9/1939 | Taft | 280/614 |
| 2,600,688 | 6/1952 | Reuge | 280/614 |
| 2,649,306 | 8/1953 | Hilding | 280/614 |
| 2,698,757 | 1/1955 | Berlenbach | 280/614 |
| 2,764,418 | 9/1956 | Shimizu | 280/614 |
| 2,831,696 | 4/1958 | Jones | 280/614 |
| 3,122,380 | 2/1964 | Eckel | 280/625 |
| 3,877,712 | 4/1975 | Weckeiser | 280/614 |
| 3,901,523 | 8/1975 | Burger | 280/614 |

FOREIGN PATENTS OR APPLICATIONS

| | | | |
|---|---|---|---|
| 1,120,333 | 12/1961 | Germany | 280/619 |
| 474,278 | 8/1969 | Switzerland | 280/614 |

*Primary Examiner*—Joseph F. Peters, Jr.
*Assistant Examiner*—Milton L. Smith
*Attorney, Agent, or Firm*—John E. Reilly

[57] ABSTRACT

A bracket for receiving the toe edge of a ski boot sole is attached to the surface of a ski so as to accommodate both lateral and perpendicular pivoting of the boot relative to the ski surface. A lateral release mechanism is included and a cable or other biasing means maintains pressure against the boot in the direction of the toe bracket. By appropriately positioning a single pin, the lateral pivoting or the perpendicular pivoting can be prevented so as to accommodate either downhill or cross-country skiing.

12 Claims, 8 Drawing Figures

CONVERTIBLE SKI BINDING

BACKGROUND OF THE INVENTION

The present invention relates to apparatus for binding the boot of a skier to the surface of a ski. More particularly, the present invention relates to ski binding apparatus which can be used for either downhill or cross-country usage. The present invention is particularly useful for providing a single common ski binding structure which can be easily converted so that the boot or shoe of a skier is appropriately secured to the ski surface for any of the typical environments encountered by skiers.

Because of conflicting requirements, ski bindings and harness developments of the past have generally been directed to utilization either in downhill skiing or cross-country skiing. For cross-country or touring usage, the mechanism for restraining the ski boot relative to the skiing surface must be capable of vertical pivoting to accommodate a walking type motion while securely retaining the boot to the ski. Conversely, ski bindings for downhill use should not allow any vertical motion of the boot but should include means for permitting a horizontally lateral release movement to reduce the hazard of injury to the skier particularly in a fall. However, such horizontally lateral release devices are undesirable when the skier is traversing in a cross-country mode. That is, a binding as developed for downhill use must firmly hold the skier's boot on the ski in a fixed position to give the skier control of his skis. Conversely, cross-country use requires allowance for raising of the boot heel to a near vertical position as the skier strides forward while skiing cross-country. Accordingly, any ski binding which is to be used for both downhill and cross-country must allow the skier to quickly and reliably shift the mechanism so as either to retain the heel in fixed position on the ski but with potential lateral release or to a mode wherein the heel is allowed to raise from the ski but not permit it to pivot on the ski surface as would be effected by an operable lateral release mechanism.

Although predating confined slope downhill skiing, ski touring or cross-country skiing has drawn increased attention recently particularly since it represents a pleasurable and inexpensive recreational sport. However, even when cross-country skiing, a considerable portion of such tours are engaged in downhill skiing. Accordingly, the ski binding must be selectively convertible to accommodate the walking motion as involved in traversing terrains and also downhill skiing. Furthermore, since the cross-country skier is frequently in isolated areas, it is imperative that the ski binding mechanism be as reliable as possible and have minimal mechanical failure hazard. Still further, it is imperative that any failure which does occur be easily repaired and not require special tools or components. Skiers and the ski industry have long recognized the need for a versatile binding which is of minimal and simplified mechanical structure and which is further lightweight, and durable but reliably releasable when required.

Several approaches have been taken in the prior art to resolve the problem of converting a ski binding between downhill and cross-country use. For instance, some devices have been employed which will permit bending of the boot or restrain its bending as in U.S. Pat. No. 1,964,103 by Attenhofer. A somewhat similar approach except employing a bracket which can be pivoted or clamped against pivoting is shown in Taft U.S. Pat. No. 2,172,669. Since such devices do not provide secure retention of the boot heel against the ski surface, other devices have been developed to resolve this problem by using flexible plates for underlying the boot with the plate hinged at the toe and including means for selectively restraining the plate from pivoting. Examples are Hilding U.S. Pat. No. 2,649,306, Reuge U.S. Pat. No. 2,600,688, Berlenbach U.S. Pat. No. 2,698,757, Jones U.S. Pat. No. 2,831,696 and Weckeiser U.S. Pat. No. 3,877,712. Shimizu U.S. Pat. No. 2,764,418 has suggested an arrangement for avoiding the use of a separate hinge or flexible plate by employing a special arrangement of restraining collar and cable harness structure. In Shimizu, a cable hold-down hook arrangement is employed to selectably hold the boot in its flat position or can be released so as to permit flexing with the boot being retained in position by the special harness thereof. Other bindings intended for convertible use are the so-called Silveretta of German manufacture and the Ramy Securus bindings of French design.

Although a binding as shown by the above-mentioned Hilding patent is of relatively simple mechanical structure, it suffers from several disadvantages. For instance, the ski boot must be permanently attached to the hinged plate which thus makes it unavailable for use separate from the ski and further prevents the lateral release required for preventing injury. Similar disadvantages are associated with the semi-permanent attachment structure such as that shown by Taft, Berlenbach and Weckeiser.

It is preferable to use a stiff or semi-flexible soled boot when skiing with a combination binding. This is true since the boot, when clamped tightly to the ski for downhill use, must not buckle as with a soft-soled boot in order to allow the skier to control his skis. However, apparatus such as Taft, Shimizu and possibly Berlenbach employ soft-soled boots thus rendering these bindings inferior for downhill use. Furthermore, the utilization of complex mechanisms to obtain the combination status as with the Ramy Seccurus, Berlenbach patent, Jones patent and Weckeiser patent is likewise undersirable. Such complex mechanisms increase the probability of damage or breakage of components which is especially undesirable when in an isolated area thereby stranding the user.

Accordingly, despite the longstanding recognition of the problem associated with converting ski bindings between downhill and cross-country uses, there has been a continuing need for a ski binding which employs minimal lightweight but durable structure elements, which can be quickly converted between a downhill mode and a cross-country mode in the field, which establishes a secure retention of the boot sole relative to the ski surface while allowing lateral release for injury prevention as in downhill utilizations but which further permits maximum vertical flexure with no lateral release as required for the walking motion of cross-country usage.

SUMMARY OF THE INVENTION

The present invention is a ski boot binding which is capable of easy and rapid conversion between a downhill mode wherein the boot is securely retained on the ski surface but in a manner which accommodates lateral horizontal release and a cross-country mode of usage wherein the lateral release is prevented but flexure of the heel in a direction perpendicular to the ski surface is permitted. As will be described in detail for the preferred embodiment, the binding for a ski boot relative to the flat surface of a ski in accordance with this invention employs a frame or yoke which is attached to the flat surface of the ski in a manner which will allow pivotal movement between the frame and the ski in a horizontal direction parallel to the ski surface. Lateral release required for downhill skiing is provided by a frictional retention device which holds the frame relative to the ski surface so that pivotal movement therebetween must reach a predetermined magnitude of lateral force before horizontal pivoting is allowed. The leading edge or toe of the sole of the ski boot is received in a manner so as to permit pivoting relative to the frame so as to accommodate pivotal movement of the boot in its receptacle in a direction perpendicular to the ski surface while preventing horizontal pivoting between the receptacle and the frame. A pair of locking arrangements are included, one having two selectable positions which either prevent or allow the horizontal pivotal movement between the frame and ski surface with the other locking arrangement having two positions for preventing or allowing movement between the receptacle and the frame in the vertical direction. Accordingly, by securing one of the locking arrangements and releasing the other, the ski binding can accommodate flexure of the boot in a walking motion while preventing lateral release or conversely permit lateral release while retaining the boot sole against the ski surface.

As will be evident in the subsequent description, a simple locking mechanism can be used such as a single pin which is passed through aligning holes in either the frame and the ski surface or aligning holes in the receptacle and the frame. The boot can be secured in the receptacle as by a cable and spring arrangement. Further, securing of the boot relative to the ski surface can be effected by releasable hooks for cooperating with the cable.

An object of this invention is to provide a novel and improved ski binding apparatus capable of conversion between downhill and cross-country modes.

Another object of this invention is to provide a novel and improved convertible ski binding structure which provides full lateral release safety for downhill use in one mode and full boot flexure accommodation in the cross-country mode.

A further object of this invention is to provide a novel and improved ski binding structure which can be quickly converted between downhill and cross-country modes and which further provides reliable long term usage in either mode.

Yet another object of this invention is to provide a novel and improved ski binding which can be converted between downhill and cross-country adaptations through use of minimal, easily fabricated components.

A still further object of this invention is to provide a downhill/cross-country convertible ski binding which requires no modification to existing ski boots and which is lightweight and durable in structure.

The foregoing and other objects, features and advantages of the present invention will be more apparent in view of the following detailed description of an exemplary preferred embodiment.

DETAILED DESCRIPTION OF THE PREFERRED EMBODIMENT

Figure 6:
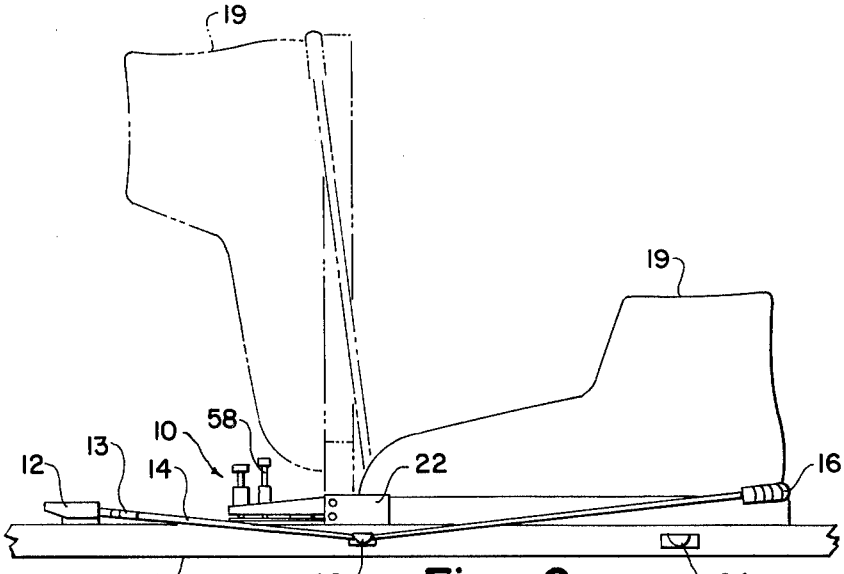
FIG. 6 is a side view illustrating utilization of the preferred embodiment for cross-country skiing.
Figure 7:
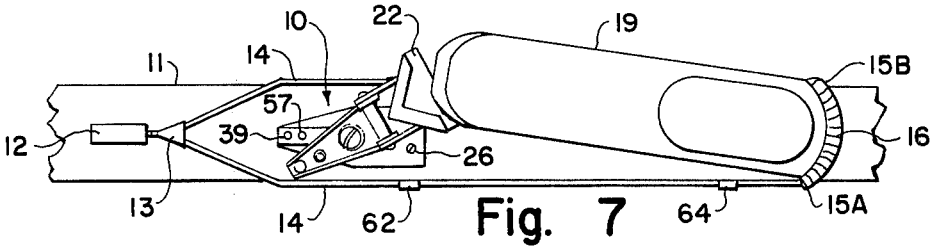
FIG. 7 is a top view of a ski including the present invention and particularly illustrating the lateral release mechanism.
Figure 8:
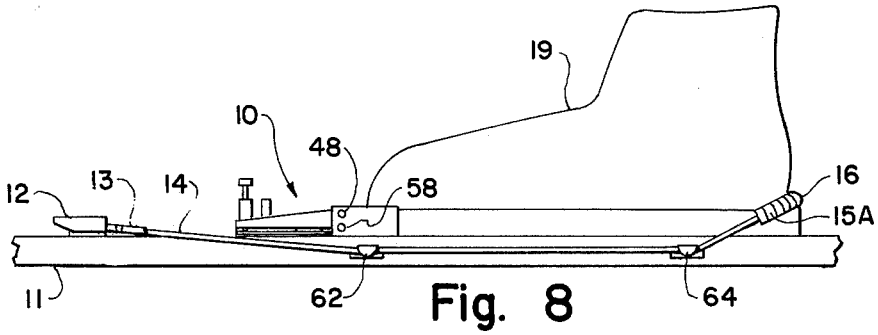
FIG. 8 is a side plan view illustrating the adaptation of the present invention for downhill skiing.

Toe plate assembly 10 in accordance with the preferred embodiment of the present invention is rigidly attached to the upper surface of ski 11 and is adapted to receive the leading edge of the sole of a typical ski boot as is best seen in FIGS. 6–8. The boot is urged towards the plate assembly 10 with one means of providing this continuous forward pressure to the boot being a conventional ski cable arrangement including releasable cable binder 12 which is likewise rigidly attached to the upper flat surface of ski 11. In accordance with existing practice, an adjustable cable holder 13 interconnects cable 14 with cable binder 12. Cable holder 13 is adjustable so as to maintain proper tautness in cable 14. Further cable 14 is serially connected with a spring 16 which has turn-buckles 15A and 15B on the ends thereof to provide additional tension adjustment. Coil spring 16 provides elasticity to the cable mechanism so as to accommodate movement of boot 19. That is, with the assembly 10 adjusted for cross-country skiing as will be described later in greater detail, boot 19 can rise to the vertical position as shown in phantom in FIG. 6 and the coil spring 16 acts as a buffer to accommodate any changes in the cable route distance. Note that the cable binder 12 and the cable holding yoke 13 can be conventional and include a pivotal lever for releasing or applying tension to cable 14 as is well known.

The toe plate assembly 10 used in conjunction with the cable binder apparatus discussed above enables the binding to be used for both downhill and cross-country skiing. The ski boot 19 to be used with this binding can vary depending upon personal preferance. A ski jumping boot or a non-flexible sole boot can be used provided that the boot top can be made flexible for cross-country skiing and the sole stiff enough so that it will not buckle when fastened to the flat surface of ski 11 for downhill use. Broadly, tow plate assembly 10 is arranged to accommodate either vertical pivotal movement as illustrated in FIG. 6 or lateral movement as shown in FIG. 7.

As shown in greater detail in FIGS. 1–5, toe plate assembly 10 is formed of three subassembly members including base plate 20, yoke or frame member 21 and toe plate receiving bracket 22. Base plate 20 is rigidly attached to the flat surface of the ski as by screws 24 and 25 shown in FIG. 3 and 26 visible in FIG. 7. As will be apparent from the subsequent description, the base plate 20, yoke 21 and toe bracket assembly 22 cooperate so as to selectably provide lateral pivoting or vertical pivoting of the boot as retained in toe plate 22.

Figure 3:
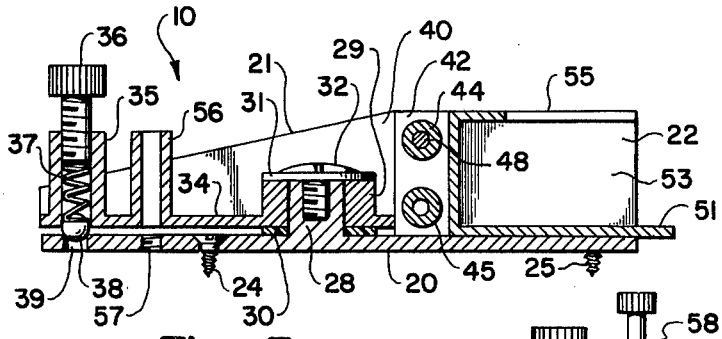
FIG. 3 is a partially sectioned view taken along line 3—3 of FIG. 2.

Base plate 20 has a post 28 extending therefrom in a direction perpendicular to the surface of the ski on which base plate 20 is attached as is best seen in FIG. 3. Post 28 pivotally attaches within collar 29 of yoke frame assembly 21 with washers 30 and 31 providing pivotal bearing surfaces and screw 32 providing attachment of yoke 21 relative to base plate 20. On the forward end of yoke 21 is an additional cylindrical collar 35 which is internally threaded to receive thumb screw 36 so as to retain spring 37 and ball 38 therein. A hole 39 through the forward end of base plate 20 provides a detent for receiving ball 38 and the screw adjustment of thumb screw 36 determines the amount of spring tension applied to ball 38 via spring 37. Thus elements 36–39 cooperate to provide the lateral or horizontal safety release for allowing the yoke 21 to pivot and free the boot of the skier in the event of a fall. This lateral releasing is particularly illustrated in FIG. 7 showing the boot 19 as it is being released as a result of lateral horizontal movement force between yoke 21 and base plate 20 in excess of the preset detent release force between ball 38 and hole or notch 39.

Figure 1:
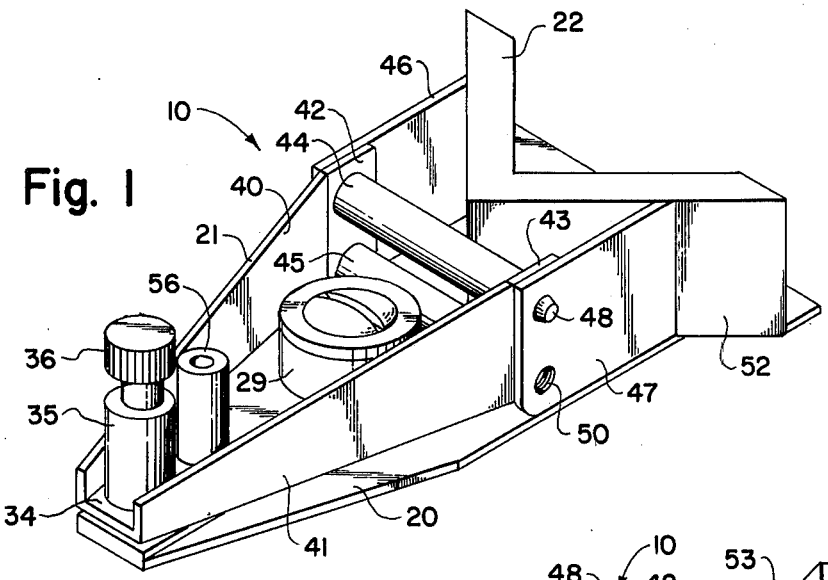
FIG. 1 is a perspective view of a toe plate structure convertible for downhill and cross-country use in accordance with the preferred embodiment.
Figure 2:
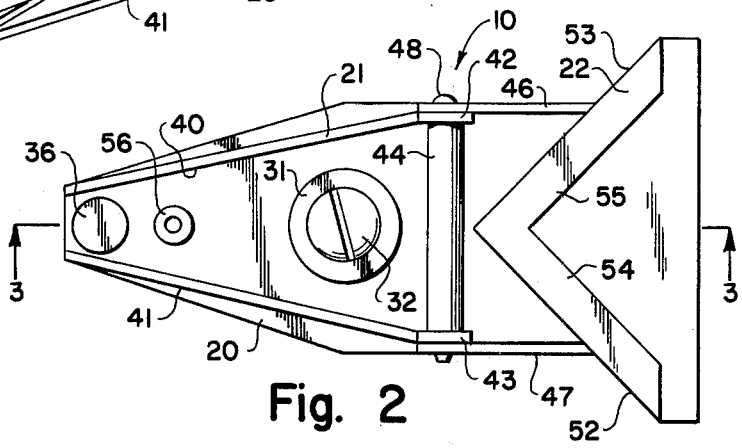
FIG. 2 is a top plan view of the FIG. 1 structure.

Yoke 21 is formed in a somewhat open channel configuration with bottom plate 34 thereof having side arms 40 and 41 extending upwardly therefrom and terminating in shoulder portions 42 and 43 respectively. A pair of hollow cylindrical spacers 44 and 45 are attached between terminating shoulders 42 and 43 with the axial openings therethrough aligning with holes through 42 and 43. Toe plate bracket 22 has a pair of side arms 46 and 47 extending therefrom in a forward direction so as to overlie shoulders 42 and 43. Shoulders 42 and 43, and arms 46 and 47 each have a pair of holes therethrough which can be aligned. The upper hole through each of members 42, 43, 46 and 47 has a shaft 48 permanently attached therethrough so as to permit pivoting in a perpendicular vertical direction by toe plate 22 relative to the surface of the ski. The lower holes through 42, 43, 46 and 47 can likewise be aligned with the bore through cylindrical shoulder 45 and one of these holes, namely hole 50 as shown in FIG. 1, is internally threaded. Toe plate assembly 22 includes a flat bottom plate 51, and a pair of vertical sidewalls 52 and 53 which are oriented in a v-shaped configuration and which terminate in overlying or upper walls 54 and 55 thereby defining a groove into which the forward extension of a typical ski boot sole can be inserted.

Figure 4:
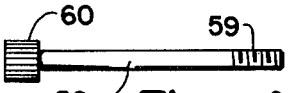
FIG. 4 is a side view of the locking pin for use with the preferred embodiments.
Figure 5:
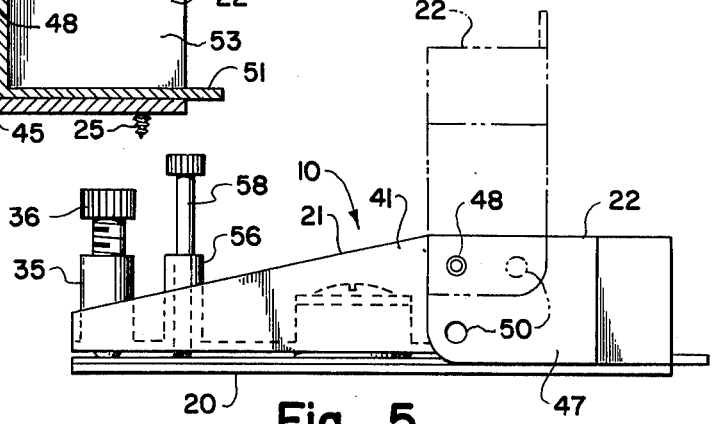
FIG. 5 is a side plan view of a toe plate in accordance with the present invention particularly illustrating vertical toe plate pivoting.

As shown in FIG. 3, a hollow vertical column 56 is positioned as an integral, vertical element of yoke 21 and can be pivotally aligned with threaded hole 57 in the base plate 20. An elongated thumb screw 58 as shown in FIG. 4 has a threaded end portion 59 and a thumb screw shoulder 60. Thus, thumb screw 58 is dimensioned so as to fit internally through cylindrical collar 56 and threadedly engaged via end 59 into hole 57 of base plate 20. In such a position as is shown in FIG. 5, the base plate 20 and yoke 21 are locked in a manner which prevents any horizontal lateral pivoting therebetween. Accordingly, by inserting thumb screw 58 as shown in FIG. 5, toe plate bracket 22 can be permitted to pivot about shaft 48 between the position shown in solid lines and the phantom position of a vertical orientation. Note that this orientation of toe plate 22 is likewise illustrated in FIG. 6.

By removing thumb screw 58 from collar 56 and inserting it through the lower holes of shoulder 42, 43, 46 and 47, so that the threaded end 59 is engaged with the internal threads of hole 50, the toe plate will be restrained against vertical pivoting but the yoke will likewise be permitted lateral horizontal movement so that the release assembly 36–38 associated with base plate hole 39 can be operative. Thus, two selectable locking positions are available, one via cylindrical column 56 and threaded hole 57 for cross-country use so as to permit vertical movement of the boot and the other including the lower holes through cylinder 45 and the appropriate side arm brackets including internally threaded hole 50 so as to select downhill operation.

In use, the cross-country skiing mode is selected by placing thumb screw 58 into forward cylindrical collar 56 and threaded engagement into hole 57 as shown in FIG. 6. Further, cables 14 are held by downwardly opening hooks 62 [the counterpart thereof on the opposite side of ski 11 not being visible] but positioned free of a rear pair of downwardly opening hooks 64, the counterpart for which is likewise not visible. Thus, the boot is retained in toe plate 22 by the forward biasing of cable 14 and the internal groove defined by bracket 22 which permits flexing between the two positions shown in FIG. 6. Preferably boot 19 is sufficiently stiff so that flexure thereof will not significantly reduce the forward biasing pressure effected via cable 14 thereby insuring that boot 19 is continuously urged into the receiving groove of the toe plate bracket 22. In use for downhill skiing, pin 58 is placed through the lower holes of side arms 42, 43, 46 and 47 as mentioned and as is shown in FIG. 8. Further, the cable 14 is inserted through both hooks 62 and 64 on one side of the ski and also through the counterpart downwardly opening hooks on the opposite side of the ski [not shown]. Thus the boot is restrained against vertical pivoting relative to the surface of ski 11 via rear hold-down hooks such as 64 whereas the assembly 10 is permitted to pivot laterally in a horizontal direction for safety release purposes as shown in FIG. 7.

Reviewing, the toe of the sole of boot 19 is inserted into the groove defined by the bracket 22 sidewalls and, with pin 58 in the forward cylindrical collar 56 and threaded hole 57, the boot is permitted to assume multiple arched positions while skiing cross-country but the toe plate is locked from release so that the boot will not twist sideways while cross-country traversing. By removing pin 58 from collar 56 and placing it in the lower holes so as to terminate in threaded hole 50, upward pivoting motion will be locked thus allowing the toe plate to be used for downhill skiing with an adjustable release toe plate. That is, by appropriately adjusting thumb screw 36 so as to control the biasing force applied by spring 37 to ball 38 in engaging as a detent into hole 39, a reliable release tailored to the body weight of the user can be effected. Although thumb screw 36 and 58 are shown with knurled end shoulders which can be slotted for screwdriver use if desired, it should be recognized that various bolting arrangements can be used including wing nuts or the like.

The various parts of the assembly 10 can be cast, forged, welded or assembled using well known techniques. As an example, these elements can be fabricated from steel which is typically 3/32nds inch thick with the overall dimension of base plate 20 being generally 1 ¾ × 4 3/16 inches with the post 28 having an outside diameter of 0.495 inches, a length of ⅞ inch and a 9/16th inch drill with threads tapped therein to a depth of 21/32nds. Collar 29 has a 0.5 inch I.D. and 11/16inch O.D. Ball 38 is 5/16th diameter and the receiving hole 39 is 3/16ths diameter. Yoke 21 is generally 2.5 × 1.5 inches terminating in a ½ inch outside diameter outside collar 35 and a ⅜ inch outside diameter cylindrical column 56 with a 13/16ths inside diameter bore through column 56. Toe plate bracket 22 had the side shoulders 46 and 47 spaced 1 9/16ths inches apart so as to fit around the outside of shoulders 42 and 43 of yoke 21 with the center line of the hole through shoulders 46 and 47 being 1 13/16ths inches from the rear of the bottom plate 51 of assembly 22. The V-shaped groove has sidewalls 52 and 53 which are 13/16ths inches high and the apex of the V is 1 and 11/32nds from the rear of the bottom plate 51 and preferably formed at a 45° angle so that shoulders 52 and 53 form a right angle at the apex. The rear edge of the base or lower surface 51 of toe plate 22 is typically 2 3/8ths inches wide. Thumb screw 58 is typically 2 5/16ths inches in length with a ½ inch threaded tip 59 and a 5/16ths inch long knurled head 60. Pin 58 is of a 3/16ths inch or slightly less diameter for the shank with the head 60 having a 3/8ths inch outside diameter. Thus, by fabricating the central bore through vertical cylindrical column 56 and the lowermost holes through shoulder 42, 43 and 46 as well as guide collar 45 with a 13/64ths inch inside diameter, pin 58 can be passed through either of these sets of holes when properly aligned and threaded into a 9/16ths inch threaded hole 57 or bore 50.

The exemplary preferred embodiment has been described hereinbefore with separate elements for toe plate bracket assembly 22 and yoke 21 since this arrangement advantageously permits use of the particular frictional lateral release mechanism 35–39 shown. However, it should be recognized that the structure can be modified in a wide variety of different ways. By way of example, the boot edge receiving toe plate 22 and yoke 21 can be effectively formed as one unit in cooperation with other lateral release mechanisms if this should be desirable. The resulting assemblage need only be arranged to accommodate both lateral and perpendicular pivotal motion of the boot relative to the ski surface with means for selectably locking one of those pivotal movements. For instance, with elements 21 and 22 formed as a single solid unit, an additional yoke could be hinged transverse to the ski surface forward of the binding so that it can be pivoted backwardly and a pivot pin inserted through a hollow collar on the forward end of the unitary toe plate assemblage to function somewhat like pin 48. Under such circumstances, a vertical pivot pin equivalent to screw 32 would be removed so as to allow perpendicular pivoting of the boot around the additional bracket hinge for cross-country use. To convert such a structure to downhill, the pin would be removed from the additional hinged bracket which would then be pivoted and locked forwardly out of the way of the assembly unit and the vertical pivot pin replaced to effect the same function as screw 32. This configuration would require some additional lateral release mechanism such as a cammed shoulder release device. However, the embodiment shown and described herein is presently preferred since it requires relatively simple and easily fabricated components which cooperate for providing reliable long-term usage.

Although the present invention has been described in detail relative to the foregoing exemplary preferred embodiment, various changes, additions, modification and applications other than those specifically mentioned herein will be readily apparent to those having normal skill in the art without departing from the spirit of this invention.

What is claimed is:

1. In an apparatus for binding a boot or the like to a flat surface of a ski, an improvement comprising:

boot-receiving means attached to the flat surface of a ski adapted for receiving the leading edge of a boot, including first pivot means pivotally attaching said boot-receiving means to the ski for pivotal movement parallel to the ski surface, and second pivot means pivotally attaching said boot-receiving means to the ski for pivotal movement of said receiving means in a direction perpendicular to the ski surface;

male locking means; and first and second female receiving means, said first female receiving means being adapted to releasably receive said male locking means for securing said boot-receiving means against pivotal movement parallel to the ski flat surface, and said second female receiving means being adapted to releasably receive said male locking means for alternatively securing said boot-receiving means against pivotal movement perpendicular to the ski flat surface.

2. Apparatus in accordance with claim 1 wherein said boot-receiving means includes a toe plate member including an open channel for receiving the boot edge and a frame means coupled to said toe plate member by said second pivot means, said first pivot means including a base plate rigidly attached to the ski flat surface and having a post extending therefrom perpendicular to the ski flat surface, said first pivot means including a collar on said frame means having a bore therethrough for pivotal mounting on said post.

3. Apparatus in accordance with claim 2, wherein said male locking means further includes at least one pin means, said first female receiving means including holes in said base plate and said frame means with said holes being axially perpendicular to the ski flat surface and further being alignable for receiving said pin means.

4. Apparatus in accordance with claim 3 wherein said second female receiving means includes bores in said toe plate member and said frame means with said bores being axially parallel to the ski flat surface and further being alignable for receiving said pin means.

5. Apparatus in accordance with claim 1 which includes resilient means attached to the ski for engaging the boot and applying a force thereto in a direction toward said toe plate member, said toe plate member channel including a transverse slot for surroundingly receiving the edge of the boot sole at the toe end of the boot.

6. Apparatus in accordance with claim 5 which further includes a frame means coupled to said boot-receiving means by said second pivot means and pivotal about said first pivot means and means frictionally retaining said frame means relative to the ski flat surface for restraining said frame means pivotal movement until a predetermined magnitude of lateral force exists between said frame means and the ski flat surface, at least one pair of hooks attached on opposite sides of the ski in proximity to the area of the ski on which the boot heel is positioned when the boot sole is in said toe plate member channel, said hooks each opening away from the surface of the ski on which said frame means is attached, said resilient means including a cable attached at one end to the ski in proximity to the area on which said frame means is attached, said cable being adapted to extend around the heel of the boot and further being adaptable for selectable engagement with said hooks.

7. Apparatus in accordance with claim 6 which further includes a second pair of hooks attached to opposite sides of the ski in proximity to the area of attachment of said frame means to the ski surface with said hooks each being adapted for slidably receiving said cable therein, said resilient means further including spring means connected serially with said cable and turnbuckle means rigidly attached on one end to the ski and connected on the other end to the serial connection of said cable and said spring means.

8. Ski boot binding apparatus comprising:

a ski having an elongated flat surface, a base plate rigidly attached on said flat surface and including a post extending therefrom perpendicular to said flat surface and a hole extending into said base plate in spaced relation to said post, a yoke having a flat portion including a collar for pivotal mounting on said post and a hole therethrough for aligning with said base plate hole, said yoke having a pair of side arms extending perpendicularly from said flat portion in spaced relation from said collar and each having first and second bores therethrough axially parallel to said ski flat surface, a toe plate bracket having a groove on one side adapted for surroundingly receiving the front extension of a boot sole and further having a pair of side arms extending from the side thereof opposite said groove, said bracket side arms each having first and second bores therethrough, a shaft adapted to extend through said first bores of said side arms of said yoke and said toe plate bracket for pivotal attachment therebetween, means frictionally retaining said yoke relative to said base plate for restraining said yoke against pivotal movement around said post until a predetermined magnitude of lateral force exists in a direction parallel to said ski surface between said yoke and said base plate, resilient means attached to said ski for applying a continuous force to the boot sole in a direction towards said toe plate bracket groove, means selectably cooperative with said resilient means for restraining movement of the boot heel from said ski flat surface, and pin means adapted for selectable positioning in the aligned said holes of said base plate and said yoke as well as in the aligned said second bores of said yoke and said toe plate bracket, whereby placement of said pin means in said aligned second bores in conjunction with said resilient means restraining means adapts said ski for appropriate lateral boot release in downhill skiing usage whereas placement of said pin means in the aligned said holes and release of said resilient means restraining means accommodates walking motion of the boot sole in cross-country skiing usage.

9. Ski boot binding apparatus in accordance with claim 8 wherein said resilient means includes a spring biased cable with the ends of said cable being attached to said ski in proximity to said base plate, said cable being of a length for looping around the heel area of a boot when the sole thereof is positioned in said toe plate bracket groove, said means for restraining said resilient means including a pair of hooks attached on opposite sides of said ski in proximity to the heel of the boot, said hooks each opening away from said ski flat surface.

10. Ski boot binding apparatus in accordance with claim 9 which further includes slack adjusting means rigidly attached on one end to said ski flat surface in a position in front of the toe of a boot when secured in cooperation with said cable by said toe plate bracket groove, the ends of said cable being connected to the other end of said slack adjusting means, and a pair of means attached to opposite sides of said ski in proximity to said base plate for slidingly guiding said cable.

11. Ski boot binding apparatus in accordance with claim 8 wherein said pin means includes a shaft having circumferential threads on one end and having on the other end a shoulder larger than either of said holes or said second bores, said base plate hole and one of said yoke side arm second bores each having internal circumferential threads for receiving said one end of said shaft.

12. Ski boot binding apparatus in accordance with claim 8 wherein said base plate includes a second hole therein, said frictionally retaining means including a ball and a spring retained within a channel in said yoke by a threaded bolt, said ball having a greater diameter than said second hole with said channel being positioned for aligning said ball with said second hole, whereby the force from said spring for detenting said ball into said second hole is adjustable through said threaded bolt.

* * * * *

UNITED STATES PATENT OFFICE

CERTIFICATE OF CORRECTION

Patent No. 4,029,336 Dated June 14, 1977

Inventor(s) Dennis J. Haimerl

It is certified that error appears in the above-identified patent and that said Letters Patent are hereby corrected as shown below:

Column 2, line 45, cancel "undersirable" and substitute -- undesirable --.

Column 2, line 50, cancel "problem" and substitute -- problems --.

Column 4, line 10, cancel "embodiments" and substitute -- embodiment --.

Column 5, line 49, cancel "v-shaped" and substitute -- V-shaped --.

Column 6, line 18, after "into" add -- the --.

Column 6, line 60, cancel "screw" and substitute -- screws --.

Column 7, line 6, cancel "11/16inch" and substitute 11/16 inch --.

Column 7, line 10, cancel "13/16ths" and substitute -- 13/64ths --

Column 7, line 11, cancel "had" and substitute -- has --.

UNITED STATES PATENT OFFICE

CERTIFICATE OF CORRECTION

Patent No. 4,029,336 Dated June 14, 1977

Inventor(s) Dennis J. Haimerl

It is certified that error appears in the above-identified patent and that said Letters Patent are hereby corrected as shown below:

Column 8, line 6, cancel "modification" and substitute -- modifications --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*